US007410073B2

(12) United States Patent
Yuhara

(10) Patent No.: US 7,410,073 B2
(45) **Date of Patent: *Aug. 12, 2008**

(54) COSMETIC CONTAINER

(75) Inventor: Yukitomo Yuhara, Chiba (JP)

(73) Assignee: Yoshida Co., Ltd., Tokyo (JP)

( * ) Notice: Subject to any disclaimer, the term of this patent is extended or adjusted under 35 U.S.C. 154(b) by 239 days.

This patent is subject to a terminal disclaimer.

(21) Appl. No.: 10/758,594

(22) Filed: Jan. 16, 2004

(65) Prior Publication Data

US 2004/0211779 A1 Oct. 28, 2004

(30) Foreign Application Priority Data

Jan. 22, 2003 (JP) ..... 2003-013742

(51) Int. Cl.
*B65D 43/16* (2006.01)
*A45D 33/00* (2006.01)

(52) U.S. Cl. ..... 220/212; 220/835; 220/729; 220/4.22; 206/235; 206/581; 132/293

(58) Field of Classification Search ..... 220/4.22, 220/212, 241, 256.1, 729, 835, 844, 848; 206/235, 581, 459.5; 132/293, 294, 295, 132/315; 40/311
See application file for complete search history.

(56) References Cited

U.S. PATENT DOCUMENTS

| | | | | |
|---|---|---|---|---|
| 1,676,621 | A * | 7/1928 | Pittelkow | 220/844 |
| 2,492,891 | A | 12/1949 | Schall | |
| 4,993,606 | A * | 2/1991 | Bolen et al. | 222/546 |
| 5,115,930 | A * | 5/1992 | Lohrman et al. | 215/227 |
| 5,199,451 | A * | 4/1993 | Montoli | 132/315 |
| 5,206,841 | A * | 4/1993 | Boucheron | 368/276 |
| 5,224,078 | A * | 6/1993 | Mallin | 368/223 |
| 5,323,364 | A * | 6/1994 | Hayashi et al. | |
| 5,323,794 | A | 6/1994 | Favre | |
| 5,727,681 | A * | 3/1998 | Li | 206/308.1 |
| 5,878,878 | A * | 3/1999 | Wu | 206/307 |
| 6,199,559 | B1 * | 3/2001 | Nikolaus et al. | 132/294 |
| 6,564,432 | B1 * | 5/2003 | Kushner | 24/3.3 |
| 6,729,747 | B1 * | 5/2004 | Wirayani | 362/356 |
| 2002/0197965 | A1 * | 12/2002 | Peng | 455/90 |
| 2004/0040570 | A1 * | 3/2004 | Shih | 132/293 |
| 2004/0074513 | A1 * | 4/2004 | Glndi | 132/293 |
| 2004/0204169 | A1 * | 10/2004 | Goradesky | 455/569.1 |

FOREIGN PATENT DOCUMENTS

DE 3105762 A * 12/1981

(Continued)

OTHER PUBLICATIONS

French Preliminary Search Report.

*Primary Examiner*—Anthony D Stashick
*Assistant Examiner*—James N Smalley
(74) *Attorney, Agent, or Firm*—Morrison & Foerster LLP

(57) ABSTRACT

A cosmetic container having a container body and a lid which opens and closes the container body, which can meet a demand that a decorated part does not peel or fall off in part from the container body or the lid, by providing a replacement cover detachably/attachably and replaceably on at least either one of the lid or the container body to cover it, and which can enhance flexibility for consumers to select an appearance according to taste.

1 Claim, 9 Drawing Sheets

FOREIGN PATENT DOCUMENTS

| | | | |
|---|---|---|---|
| FR | 856288 | A | 6/1940 |
| JP | 2002-101949 | A | 4/2002 |
| JP | 2003-052446 | A | 2/2003 |
| JP | 2004-113416 | A | 4/2004 |
| JP | 2004-135947 | A | 5/2004 |
| JP | 2004-135948 | A | 5/2004 |
| JP | 2004-154283 | A | 6/2004 |
| JP | 2004-154284 | A | 6/2004 |

* cited by examiner

COSMETIC CONTAINER

CROSS-REFERENCE TO RELATED APPLICATIONS

The present application claims priority upon Japanese Patent Application No. 2003-13742 filed on Jan. 22, 2003 which is herein incorporated by reference.

BACKGROUND OF THE INVENTION

1. Field of the Invention

The present invention relates to a cosmetic container which can meet a demand that a decorated part does not peel or drop off in part from a container body or a lid, and which can enhance flexibility to select an appearance according to consumers' taste.

2. Description of the Related Art

Generally, a cosmetic container is constructed by comprising a container body to store cosmetics, and a lid to open and close the container body. The container body and the lid which form the appearance of the cosmetic container, have conventionally been decorated by various methods in order to improve its design. The container body and the lid have been decorated, for example, by conducting surface processing by sputtering or the like, by transferring letters and patterns using transfer paper, or by layering a transparent or semi-transparent layer on top of an added pattern or the like.

Note that, the applicant of this application has filed related prior applications, Japanese Patent Application No. 2001-49000, Japanese Patent Application 2002-280340, Japanese Patent Application No. 2002-304682, Japanese Patent Application No. 2002-304683, Japanese Patent Application No. 2002-321873, and Japanese Patent Application No. 2002-321874.

Incidentally, with the conventional cosmetic containers, with an object to provide the cosmetic containers as products with high quality and with quality appearance, and so that the decorated part does not peel or drop off in part from the container body and the lid, there was a demand to integrally form the decorated part with the container body and the lid inseparably, so they cannot be separated from each other in regard to any of the above decorating methods.

This kind of demand means that the appearance of the cosmetic container is limited to a design selected by a manufacturer, and prevents consumers from freely selecting according to taste a design appearance of the cosmetic container. Therefore, the consumers could not find a cosmetic container with a design that one liked and this is considered to be a reason for the consumer's moderate consuming.

SUMMARY OF THE INVENTION

The present invention was arrived at based on the foregoing problems, and it is an object thereof to provide a cosmetic container which can meet a demand that a decorated part does not peel or drop off in part from a container body or a lid, and which can increase flexibility for the consumer to select an appearance according to taste.

In order to achieve the above object and other objects, the cosmetic container according to one embodiment of the present invention is a cosmetic container having a hinge portion coupled rotatably to a container body and comprising a lid which opens and closes the container body, characterized by comprising:

a replacement cover provided replaceably on the lid to cover it;

a through hole formed in the hinge portion towards the replacement cover;

an engaging body formed inside the through hole; and an engageable body formed in the replacement cover and inserted into the through hole to engage engageably/detachably with the engaging body.

In respect to the cosmetic container of this embodiment, a demand that the decorated part does not peel or drop off in part from the container body or the lid can be met, and the flexibility of the consumer to select the appearance according to taste can be enhanced.

Further, the cosmetic container according to another embodiment mode of this invention is a cosmetic container having a container body and a lid to open and close it, characterized by comprising:

a replacement cover provided replaceably on an outer surface of at least one of the lid and the container body to cover it;

a first groove formed by recessing from an outer surface side of the lid or the container body;

an engaging portion formed inside the first groove;

an engageable portion which is flexibly deformable and formed on the replacement cover, and inserted in the first groove and engageably/detachably engaging the engaging portion; and a second groove formed by recessing from an inner surface side of the lid or the container body and connected to the first groove, to exert operating force to the engageable portion to flexibly deform the engageable portion engaged to the engaging portion inside the first groove in order to separate the engageable portion from the engaging portion.

In respect to the cosmetic container of this embodiment mode, a demand that the decorated part does not peel or drop off from the container body or the lid in part can be met, and the flexibility of the consumer to select the appearance according to taste can be enhanced. Further the second groove to exert operating force to the engageable portion is formed by recessing from the inner surface side of the lid or the container body, so that the appearance of the cosmetic container is made to be satisfactory. Furthermore, since the engaging portion and the engageable portion are to be engaged inside the first groove, it becomes possible to appropriately prevent the replacement cover from accidentally falling off from the lid or the container body.

The object disclosed in this application and the solving means will become clear through the following description of the embodiment mode of the invention and the accompanying drawings.

BRIEF DESCRIPTION OF THE DRAWINGS

In order to facilitate a more complete understanding of the present invention and the advantages thereof, reference is now made to the following description taken in conjunction with the accompanying drawings.

DETAILED DESCRIPTION OF THE INVENTION

Figure 1:
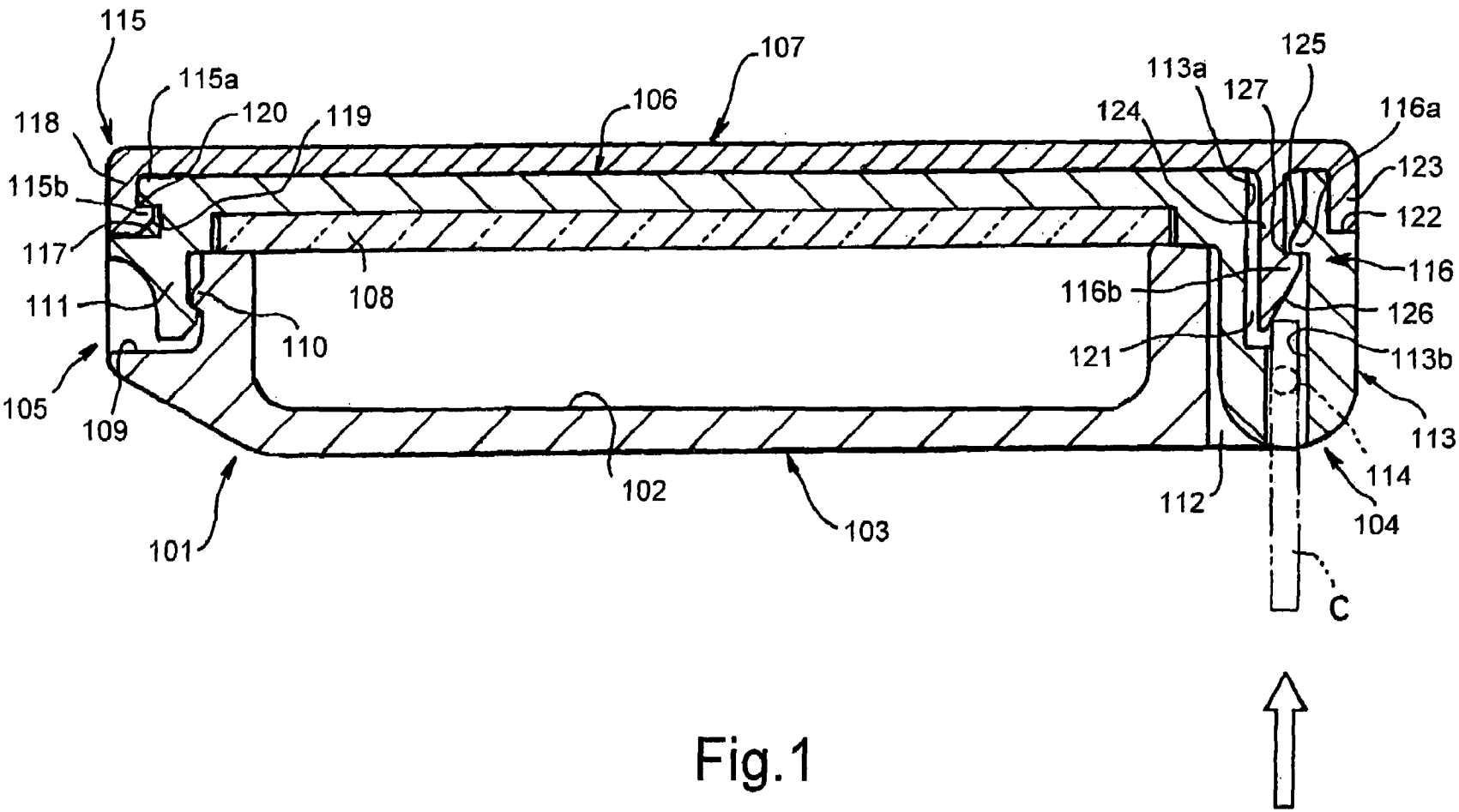
FIG. 1 is a side sectional diagram showing a preferred first embodiment of a cosmetic container according to the present invention.
Figure 2:
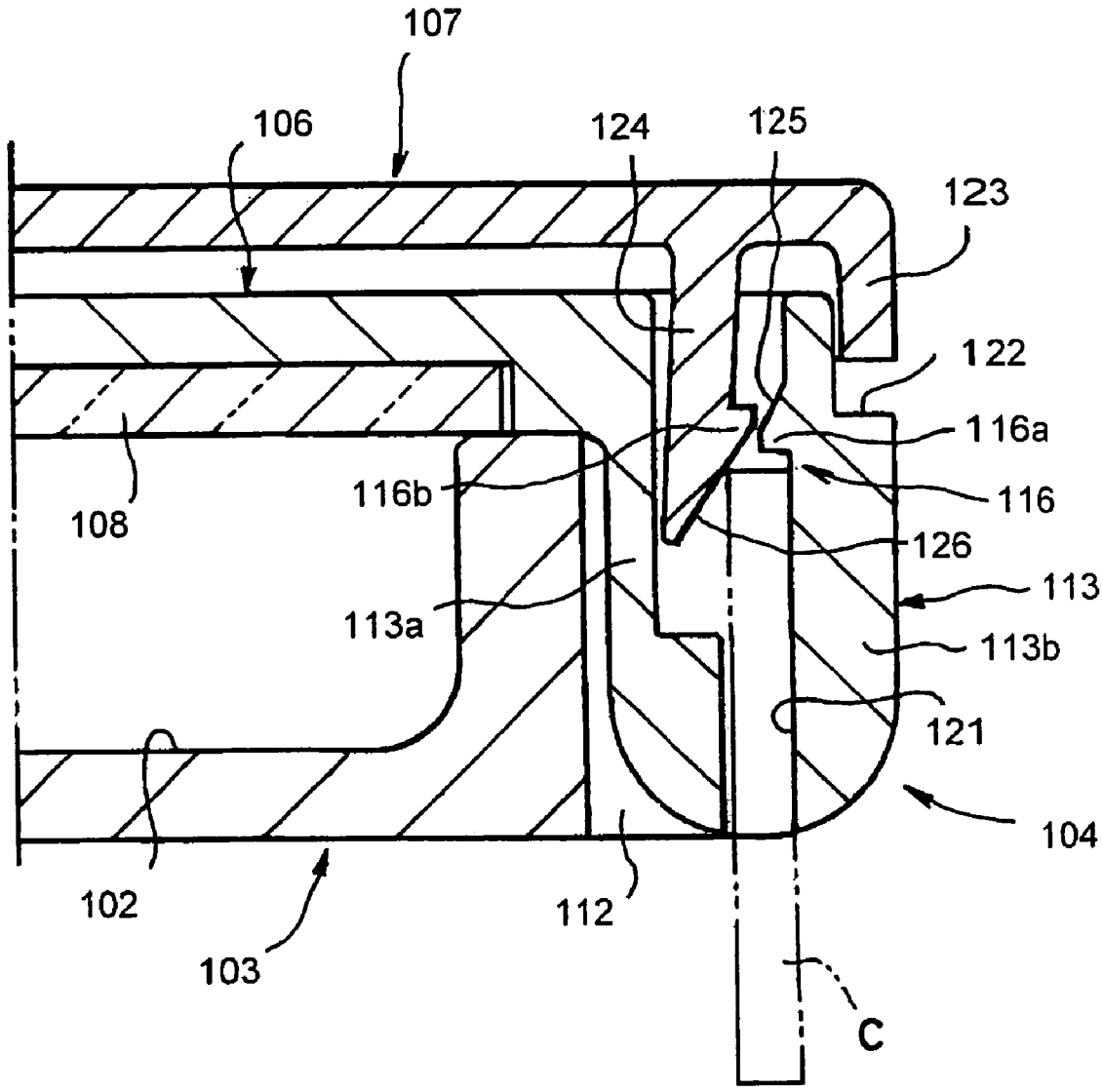
FIG. 2 is a partly enlarged side sectional diagram of the periphery of a hinge showing a removal process of a replacement cover of the cosmetic container shown in FIG. 1.
Figure 3:
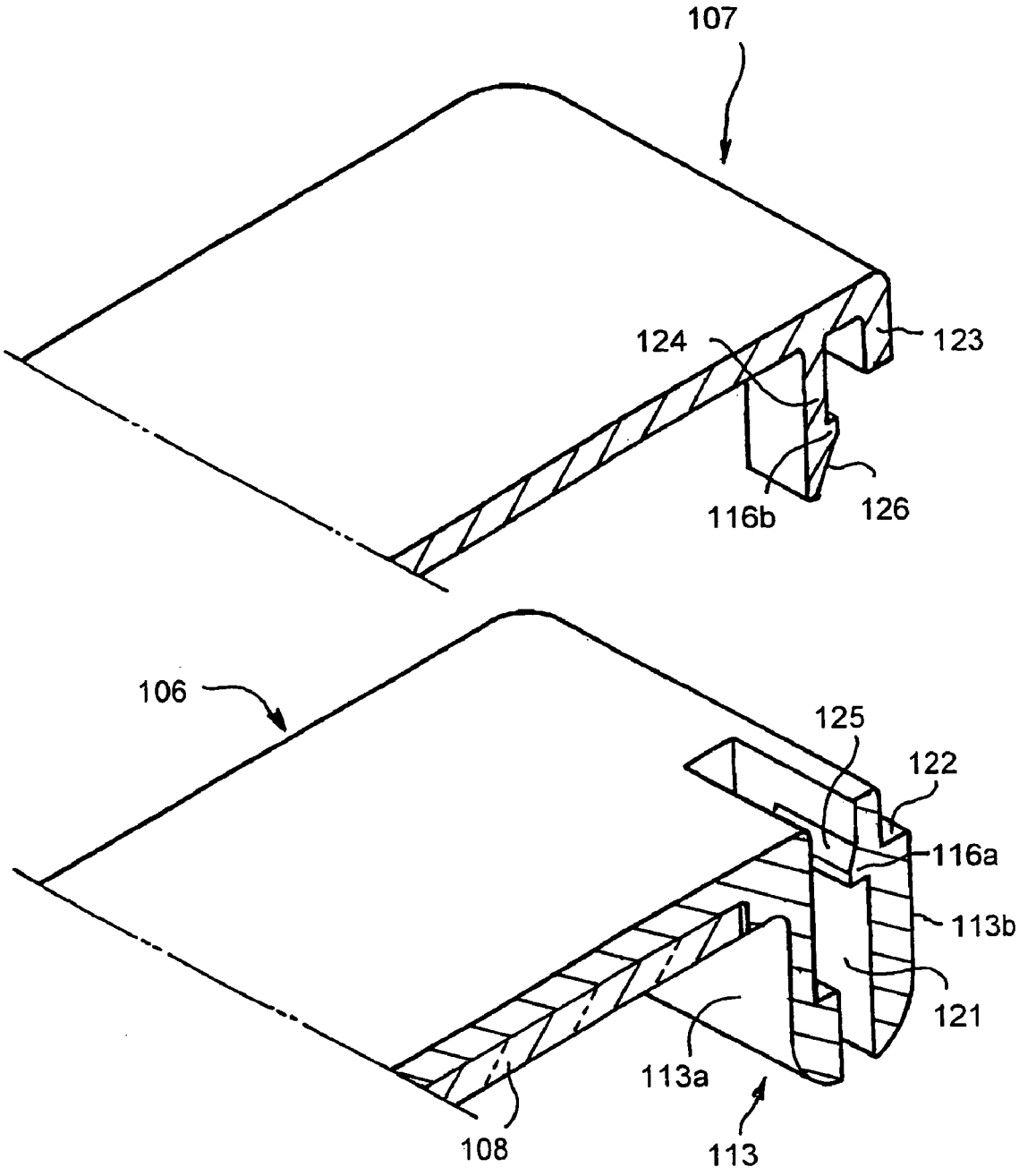
FIG. 3 is a partly enlarged perspective diagram of the periphery of a hinge, showing a removal process of the replacement cover of a cosmetic container shown in FIG. 1.

Hereinbelow, a detailed description is provided referring to the appended drawings, of several exemplary embodiment modes relating to a cosmetic container according to this invention.

FIRST EMBODIMENT

FIGS. 1 to 4 show a first embodiment mode of a cosmetic container according to the present invention. A cosmetic container 101 in the first embodiment is constructed mainly of, a dish-shaped synthetic resin container body 103 formed with a storage recess 102, and a plate-shaped synthetic resin lid 106 which is coupled rotatably in a vertical direction via a hinge 104 to one end of the container body 103 to open and close the container body 103, and which is engaged engageably/detachably via a hook 105 to another end of the container body 103 to retain a closed state of the container body 103, and a plate-shaped synthetic resin replacement cover 107 provided attachably/detachably to the lid 106 and covers the lid 106 replaceably. In the example shown, the flat outer contours of the container body 103, the lid 106, and the replacement cover 107 are formed as a rectangular shape, but they may be formed as a polygonal or a round shape. On the back surface of the lid 106 is attached a mirror 108.

The hook 105 is constructed of a hooking protrusion 110 protruding in the recess 109 formed at one end of the container body 103, and a hook piece 111 hanging down from one end of the lid 106 and engaged engageably/detachably to the hooking protrusion 110. Further, the hinge 104 is constructed so that, in between a pair of hinge pieces 112 protruding from the other end of the container body 103 at the opposite side to the hook 105, is sandwiched a hinge block 113 as a hinge part which hangs down from the other end of the lid 106, and a hinge pin 114 is inserted from the hinge blocks 113 to the hinge piece 112, and the hinge block 113 is coupled rotatably to the container body 103 by the hinge pin 114 and via the hinge pieces 112.

The replacement covers 107 are prepared as applied with various kinds of decorations, so that the consumers can flexibly select according to taste the design appearance of the cosmetic container 101, or the lid 106 in this embodiment mode. The decorated part applied to the replacement cover 107, is integrally formed with the replacement cover 107 to be inseparable and so it cannot separate by general known methods so that it does not peel or drop off in part. The replacement cover 107 is formed with an outer dimension which is substantially the same as an outer contour of the container body 103 to match it, and the lid 106 attached with the replacement cover 107 is formed with a slightly smaller outer dimension than this replacement cover in order to ensure fitting, and the replacement cover 107 covers and overlaps the top of the lid 106. The material of the replacement cover 107 is not limited to synthetic resin, and can be metal.

In between the replacement cover 107 and the lid 106 are provided a first engaging portion 115 and a second engaging portion 116 as engaging means for engageably/detachably engaging the above. These engaging portions 115, 116 are respectively provided at either ends of the lid 106 at the hook 105 side and at the hinge 104 side. The periphery of the hook 105 and the periphery of the hinge 104 of the lid 106 are formed enlarged toward the container body 103 side, and so have more space provided than general parts of the lid 106. The first engaging portion 115 at the hook 105 side is constructed by a first engaging body **115*a* at the lid 106 side, and a first engageable body 115*b* at the replacement cover 107 side. The first engaging body 115*a* is formed to protrude above the recess 117 made by recessing an entire side edge of the lid 106 with the hook piece 111 towards the hinge 104 side to form a parallel step, so as to partly cover the recess 117. Further the first engageable body 115*b* is formed by protruding a portion which corresponds to the first engaging body 115*a*, from a bent-down portion 118 which has bent down an entire side edge of the replacement cover 107 at the first engaging body 115*a* side, towards the recess 117 below the first engaging body 115*a***.

The first engaging body **115*a* and the first engageable body 115*b* engage each other engageably/detachably by overlapping the replacement cover 107 above the lid 106, so that the first engaging body 115*b* goes over the first engaging body 115*a* and into the recess 117 below. In particular, the surface of the first engageable body 115*b* facing the first engaging body 115*a* in the process of going over it, is formed as a tapered surface 119 to smoothly go over it, but the corner portions 120 of the first engaging body 115*a* and the first engageable body 115*b*** which engage each other in the engaging state, are formed with angles so that the engagement does not easily disengage.

Similarly to the first engaging portion 115, a second engaging portion 116 at the hinge 104 side is constructed of a second engaging body **116*a* at the lid 106 side, and a second engageable body 116*b* at the replacement cover 107 side. The hinge block 113 is formed with a through hole 121 in a vertical direction from its lower end towards the replacement cover 107 overlaying the lid 106, and the through hole 121 forms an interior wall portion 113*a* and an exterior wall portion 113*b* partly in the hinge block 113. On the exterior wall portion 113*b* is formed the second engaging body 116*a* which protrudes in the through hole 121. On the other hand, the replacement cover 107 is formed with a bent-down portion 123 by bending down the entire hinge side end towards the lid 106 side, to engage a recess 122 formed in the entire hinge side end of the lid 106, and at an inner side to this bent-down portion 123 is formed a second engageable body 116*b* which is inserted in the through hole 121 and engages engageably/detachably with the second engaging body 116*a***.

In this embodiment mode, the replacement cover 107 is formed with a flexibly deformable bent piece 124 bending down into the through hole 121 and having a spring characteristic, and at the lower end of the bent piece 124 is formed the second engageable body **116*b* protruding to face the second engaging body 116*a*. The second engaging body 116*a* and the second engageable body 116*b* can be engaged to each other engageably/detachably when the replacement cover 107 is overlaid on the lid 106, so that the second engageable body 116*b* goes over the second engaging body 116*a*. Regarding the second engaging portion 116, in the process of going over each other the surfaces of the second engaging body 116***a* and the second engageable body 116*b* facing each other, are formed as tapered surfaces 125, 126 to be able to go over each other smoothly, but the corner portions 127 of the second engaging body 116*a* and the second engageable body 116*b* which engage each other in an engaged state are formed with an angle so that it is hard to disengage from each other. Further, regarding the tapered surface 126 of the second engageable body 116*b*, it can be operated from the lower end of the hinge block 113 via the through hole 121, and also functions as an operating portion when disengaging the engagement of the second engaging portion 116.

In describing the action of the cosmetic container 101 according to this embodiment mode, at the time the consumer who has bought the cosmetic container 101 is replacing the replacement cover 107 attached to the lid 106 with a new replacement cover 107 of a different design, with the container body 103 in a state closed by the lid 106, an article C for operating, for example a coin, is inserted insertably/extractably from the lower end of the hinge block 113 into the through hole 121 towards the tapered surface 126 of the second engageable body 116*b*. When the tapered surface 126 is pressingly operated by the article C, with the flexible deformation of the bent piece 124, the second engageable body 116*b* is separated from the second engaging body 116*a*, and then the replacement cover 107 is lifted up from the lid 106. In this way by disengaging the second engaging portion 116 and separating the replacement cover 107 from the lid 106, the engagement of the first engaging body 115*a* and the first engageable body 115*b* of the first engaging portion 115 can be disengaged, and the replacement cover 107 can be removed from the lid 106.

Next, at the time of attaching a new replacement cover 107 to the lid 106, with the first engaging portion 115 in an engaged state, and by pressing the replacement cover 107 towards the lid 106 at the second engaging portion 116 side, the second engageable body 116*b* engages with the second engaging body 116*a* with flexible deformation of the bent piece 124. Thus, a new replacement cover 107 overlays the lid 106 and is attached.

As described above, in respect to the cosmetic container 101 according to the first embodiment described above, the lid 106 comprises a replacement cover 107 provided replaceably to cover it, a through hole 121 formed towards the replacement cover 107 in the hinge block 113, a second engaging body 116*a* formed in the through hole 121, and a second engageable body 116*b* formed on the replacement cover 107 and inserted in the through hole 121 to engage engageably/detachably to the second engaging body 116*a*, so that the appearance of the cosmetic container 101 is not limited to a design selected by the manufacturer, and the consumers can select with high flexibility the appearance of the cosmetic container 101 according to one's taste, thus it is possible to increase the consumer's purchasing inclination. Similar to conventional lids and the like, the replacement cover 107 is to be integrally formed with the decorated part as inseparable and so they do not separate from each other, and thus the decorated part does not peel or fall off in part from the replacement cover 107, and the cosmetic container 101 as a product can be provided with quality appearance and high quality as compared to conventional ones.

Further, a first engaging portion 115 and a second engaging portion 116 are provided in between the replacement cover 107 and the lid 106 to engage them engageably/detachably. With the engaging and detaching operation of the engaging portions 115, 116, the replacement cover 107 can easily be replaced. In particular, by providing a second engaging portion 116 in the through hole 121 formed in the hinge block 113, and by using the hinge block 113, the second engaging portion 116 can be reasonably provided without making the outer dimension of the cosmetic container 101 large. Further, since the through hole 121 is formed from the lower end of the hinge block 113 towards the replacement cover 107, the through hole 121 which is the replacement operation position is open at a bottom portion or the underside of the cosmetic container 110 and does not show, thus the appearance of the cosmetic container 101 is maintained as satisfactory. Further, a flexibly deformable bent piece 124 is formed on the replacement cover 107, which is formed with the second engageable body 116*b*, so that the operability of the engaging and detaching operation of the second engaging portion 116 can be increased using the flexibly deformable action of the bent piece 124.

Figure 4:
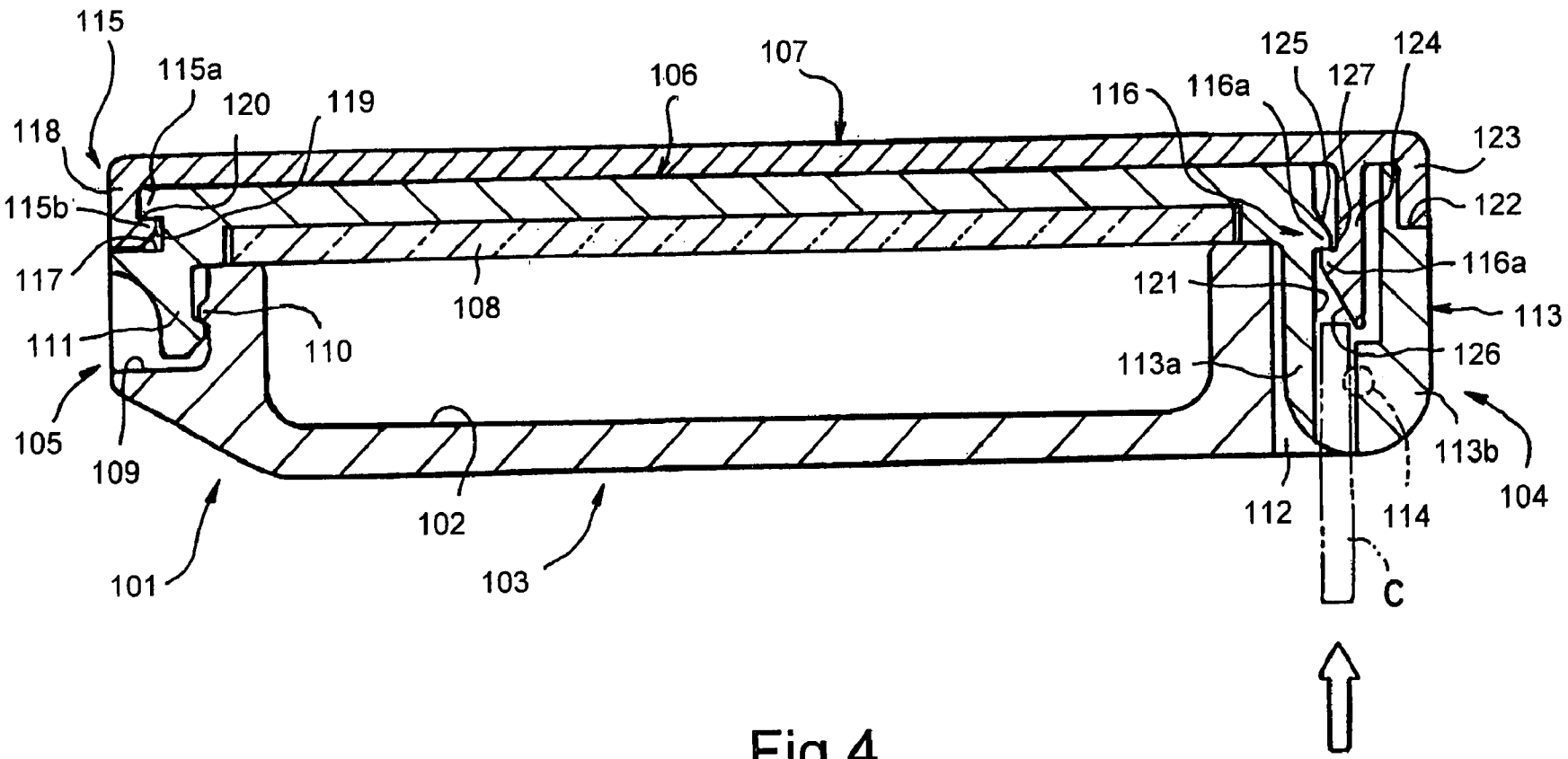
FIG. 4 is a side sectional diagram showing a modified example of the first embodiment mode of the cosmetic container according to this invention.
Figure 5:
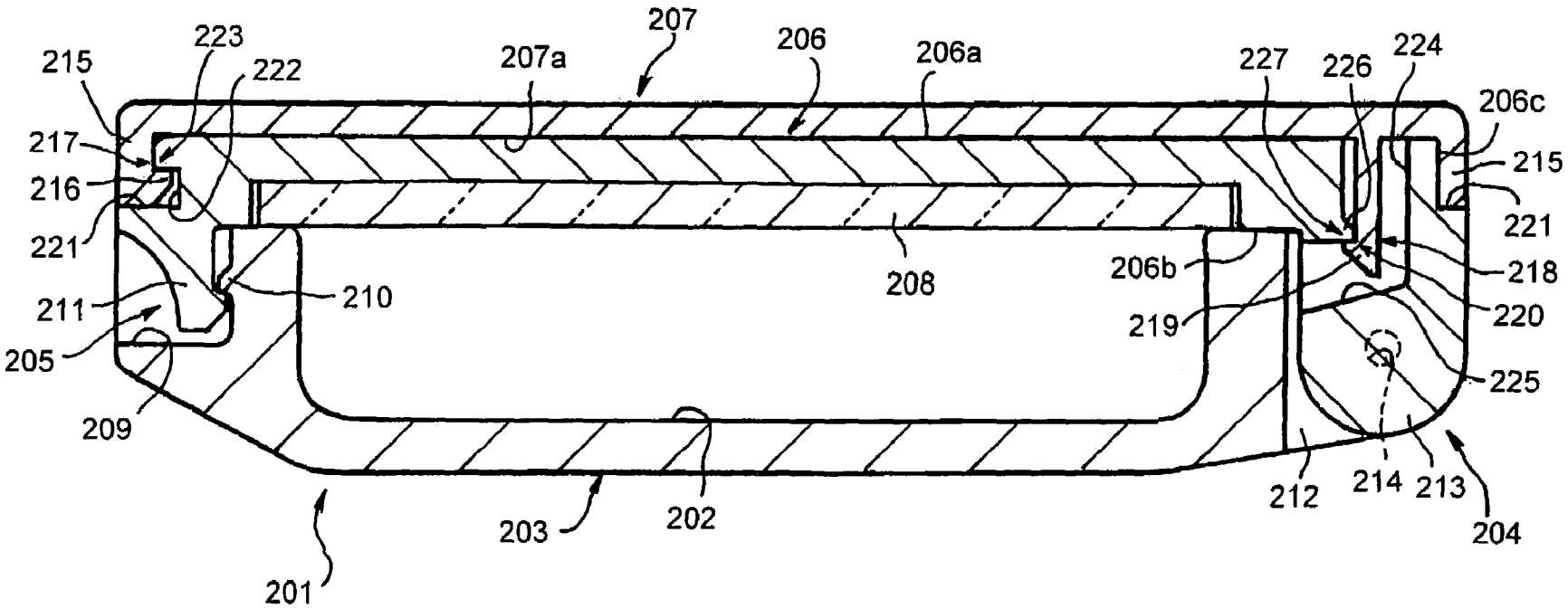
FIG. 5 is a side sectional diagram showing a preferred second embodiment of the cosmetic container according to this invention.

FIG. 4 shows a modified example of the above first embodiment mode. In this modified example, the second engaging body 116*a* is formed on the interior wall portion 113*a* of the hinge block 113, so that the directions of the second engaging body 116*a* and the second engageable body 116*b* are opposite to each other for engagement. In such a modified example, similar action/effect as the above embodiment mode can of course be obtained.

SECOND EMBODIMENT MODE

FIGS. 5 to 9 show a second embodiment mode of a cosmetic container according to the present invention. A cosmetic container 201 according to the second embodiment is constructed mainly of a dish-shaped synthetic resin container body 203 formed with a storage recess 202, a plate-shaped synthetic resin lid 206 coupled rotatably in a vertical direction via a hinge 204 to the back end in the longitudinal direction of the container body 203 to open and close the container body 203, and engaged engageably/detachably via a hook 205 to the front end of the container body 203 to retain a closed state of the container body 203, and a plate-shaped synthetic resin replacement cover 207 to replaceably cover an outer surface 206*a* of the lid 206.

The material of the replacement cover 207 is not limited to synthetic resin, and can be metal. Further, the replacement cover 207 can be provided covering the container body 203, and can be provided to both the lid 206 and the container body 203. In the example shown, the container body 203, the lid 206, and the replacement cover 207 are formed with the flat outer contours as a rectangular shape, but they can be a polygonal or a round shape. On an inner surface 206*b* of the lid 206 is attached a mirror 208.

The hook 205 is constructed of a hooking protrusion 210 protruding in the recess 209 formed at the front end of the container body 203, and a hook piece 211 which bends down from the front end of the lid 206 and engages a hooking protrusion 210 engageably/detachably. Further, the hinge 204 is constructed by sandwiching a hinge block 213 bending down from the back end of the lid 206 in between a pair of hinge pieces 212 protruding from the back end of the container body 203 at an opposite side to the hook 205, and inserting a hinge pin (not shown) in a pin hole 214 formed across the hinge block 213 and the hinge pieces 212, and the hinge block 213 is coupled rotatably to the hinge pieces 212 by a hinge pin.

The replacement cover 207 is prepared with various kinds of decoration applied to it so that the design appearance of the cosmetic container 201, or the lid 206 in this embodiment, can be flexibly selected by the consumer according to taste. The decorated part to be applied to the replacement cover 207 is integrally formed as inseparable and so it cannot separate from the replacement cover 207 by a generally known method, so that it does not peel or drop off in part.

The replacement cover 207 is formed with an outer contour that has substantially the same outer dimension as the outer contour of the container body 203 to match it, and the lid 206 attached with the replacement cover 207 is formed with a slightly smaller outer dimension than the cover to ensure fitting, and the replacement cover 207 is made to cover and overlay the lid 206.

The replacement cover 207 is formed with an annular bent-down portion 215 which bends down from the peripheral edge to the lid 206 side. The bent-down portion 215 at the hook 205 side forms an engaging protrusion portion 216 by turning back to a lower surface 207*a* side of the replacement cover 207 with an appropriate interval in the horizontal width direction of the container body 203, and forms an inner corner portion 217 with an angle made by the engaging protrusion portion 216. Further, the lower surface 207*a* of the replacement cover 207 is provided with a resilient piece 218 as an engageable portion which is flexibly deformable in the horizontal direction, to protrude downwardly from a position right above the hinge block 213. At the lower end of the resilient piece 128 is formed an engaging protrusion 219 protruding forward in the longitudinal direction of the lid 206, and the engaging protrusion 219 forms an inner corner portion 220 with an angle in the resilient piece 218.

On the other hand, the lid 206 is formed with an annular flange portion 221 on which is placed the bent-down portion 215 of the replacement cover 207 which protrudes outwardly from the peripheral wall 206*c*. Further, the peripheral wall 206*a* at the hook 205 side is recessed in order to form an engaging recess 222 for inserting insertably/detachably the engaging protrusion portion 216 of the replacement cover 207, and this engaging recess 222 forms an outer corner portion 223 with an angle. The replacement cover 207 is attached from the hook 205 side of the lid 206 and the engaging protrusion portion 216 is inserted in the engaging recess portion 222, to engage the inner corner portion 217 engageably/detachably in the horizontal direction so that it cannot be separated from the outer corner portion 223 in the vertical direction.

Further, the lid 206 is formed with a first groove 224 by recessing from its outer surface 206*a* side to the hinge block 213 in the vertical direction, to insert the resilient piece 218 insertably/detachably. Further, the hinge block 213 is formed with a second groove 225 by recessing in a substantially horizontal direction from an inner surface 206*b* of the lid 206, facing a mirror 208, that is an opposite side to the outer surface 206*a* of the lid 206, which is connected with a first groove 224. The first groove 224 and the second groove 225 form an L-shaped hole in the hinge block 213.

In the first groove 224 is formed a convex rib 226 as an engaging portion which protrudes from its inner surface towards the engaging protrusion 219 of the resilient piece 218 backwards in the longitudinal direction of the lid 206, and the convex rib 226 forms an outer corner portion 227 which faces an inner corner portion 220 with an angle. The outer corner portion 227 is engaged engageably/detachably in the horizontal direction to the inner corner portion 220 so it cannot be separated in the vertical direction, by engaging the engaging protrusion 219 of the resilient piece 218 inserted in the first groove 224 to below the convex rib 226.

The second groove 225 is provided to exert an operating force in the horizontal direction to flexibly deform the resilient piece 218 so as to separate the engaged protrusion 219 of the resilient piece 218 which is engaged to the convex rib 226 inside the first groove 224, and is connected to the first groove 224 at a position where the engaging protrusion 219 extends to. A pressing operation tool P such as a coin to exert operating force to the resilient piece 218 is inserted in the second groove 225, so that the inserted pressing tool P can deform the resilient piece 218 in the horizontal direction.

Figure 6:
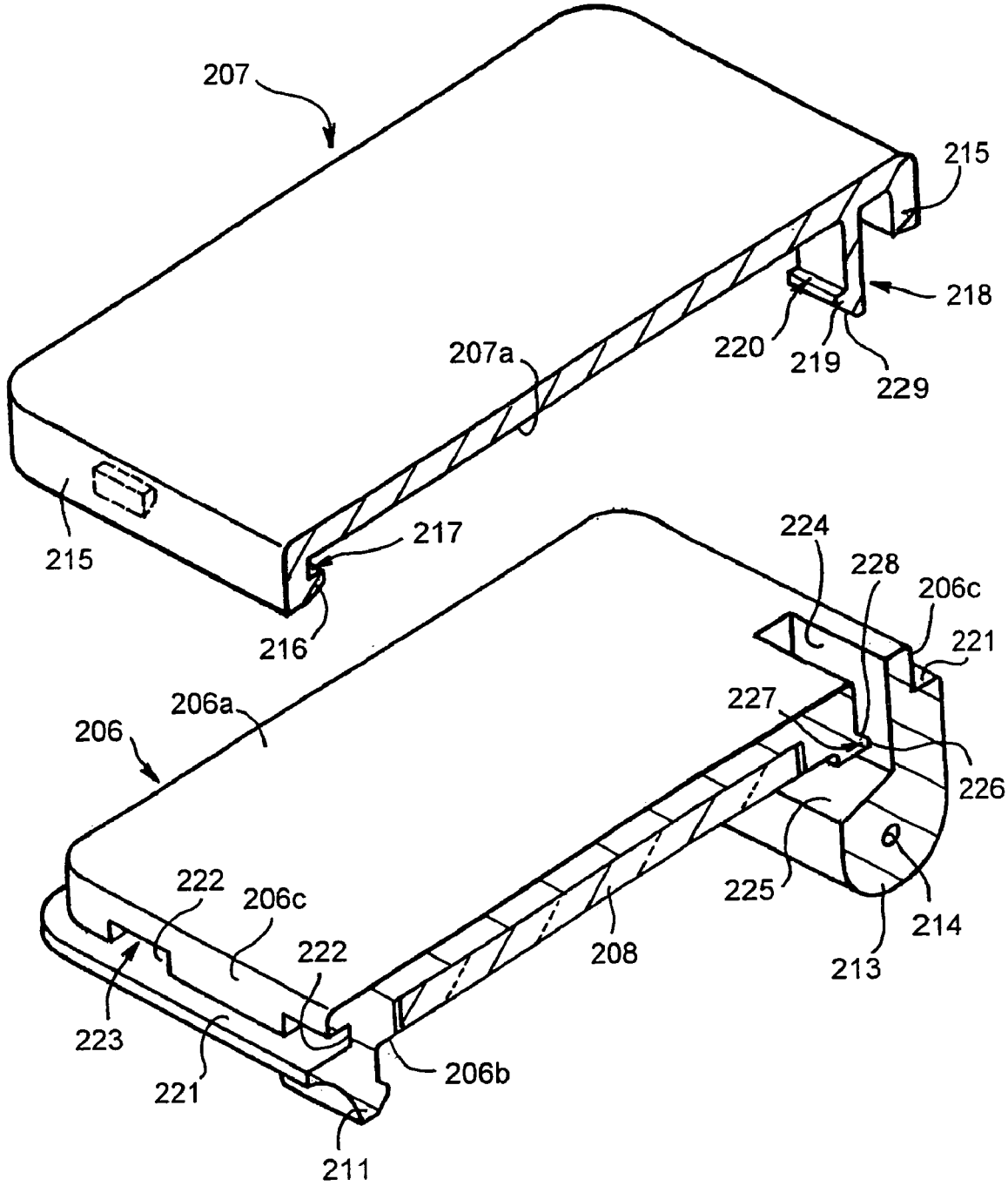
FIG. 6 is a partly cutaway perspective sectional diagram of the cosmetic container in FIG. 5.

Further, as shown in FIG. 6 in respect to the engaging protrusion 219 and the convex rib 226, the surfaces that face each other in the process when the engaging protrusion 219 goes over the convex rib 226, are formed as tapered surfaces 228, 229 to be able to go over each other smoothly. In between the tapered surface 29 of the engaging protrusion 219 and an inner surface of the second groove 225 as shown in FIG. 7, there is formed a wedge shaped gap G which is narrowed subsequently towards the back of the second recess 225, that is, along an inserting direction of the press operation tool P, to press the resilient piece 218 along the first groove 224, in order to separate the replacement cover 207 from the lid 206, and the press operation tool P is inserted to convert a part of operating force to pressing force.

Figure 7:
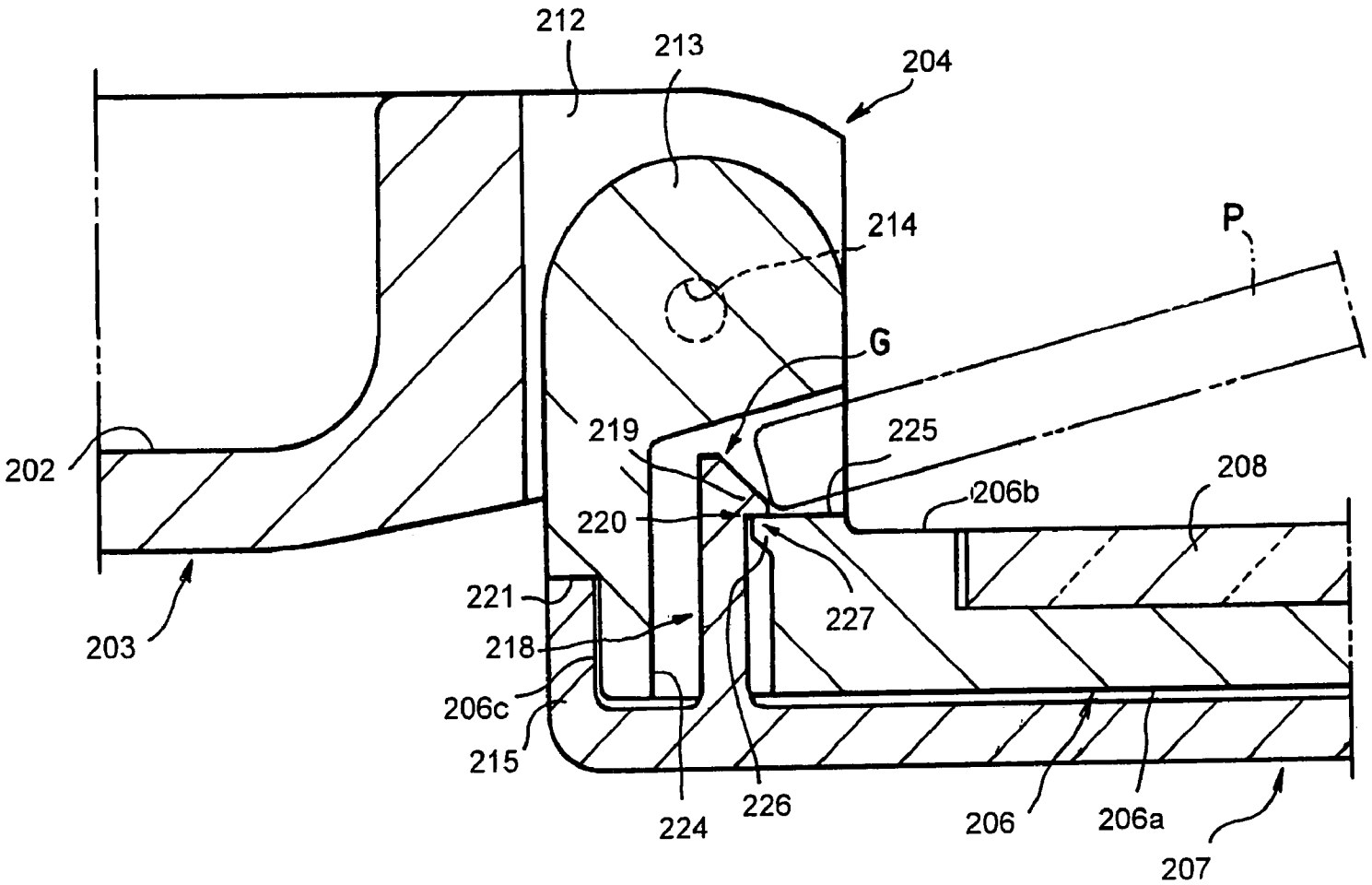
FIG. 7 is a partly enlarged side sectional diagram of the periphery of a hinge block showing a first step of removing a replacement cover of the cosmetic container in FIG. 5.

In describing the action of the cosmetic container 201 according to the second embodiment, when the consumer who has bought the cosmetic container 201 is replacing the replacement cover 207 attached to the lid 206 to a new replacement cover 207 with a different design, the lid 206 is rotated to open the container body 203, and the pressing tool P is inserted towards the engaging protrusion 219 into the second groove 225 appearing in the inner surface 206*b* of the lid 206 as shown in FIG. 7.

Figure 8:
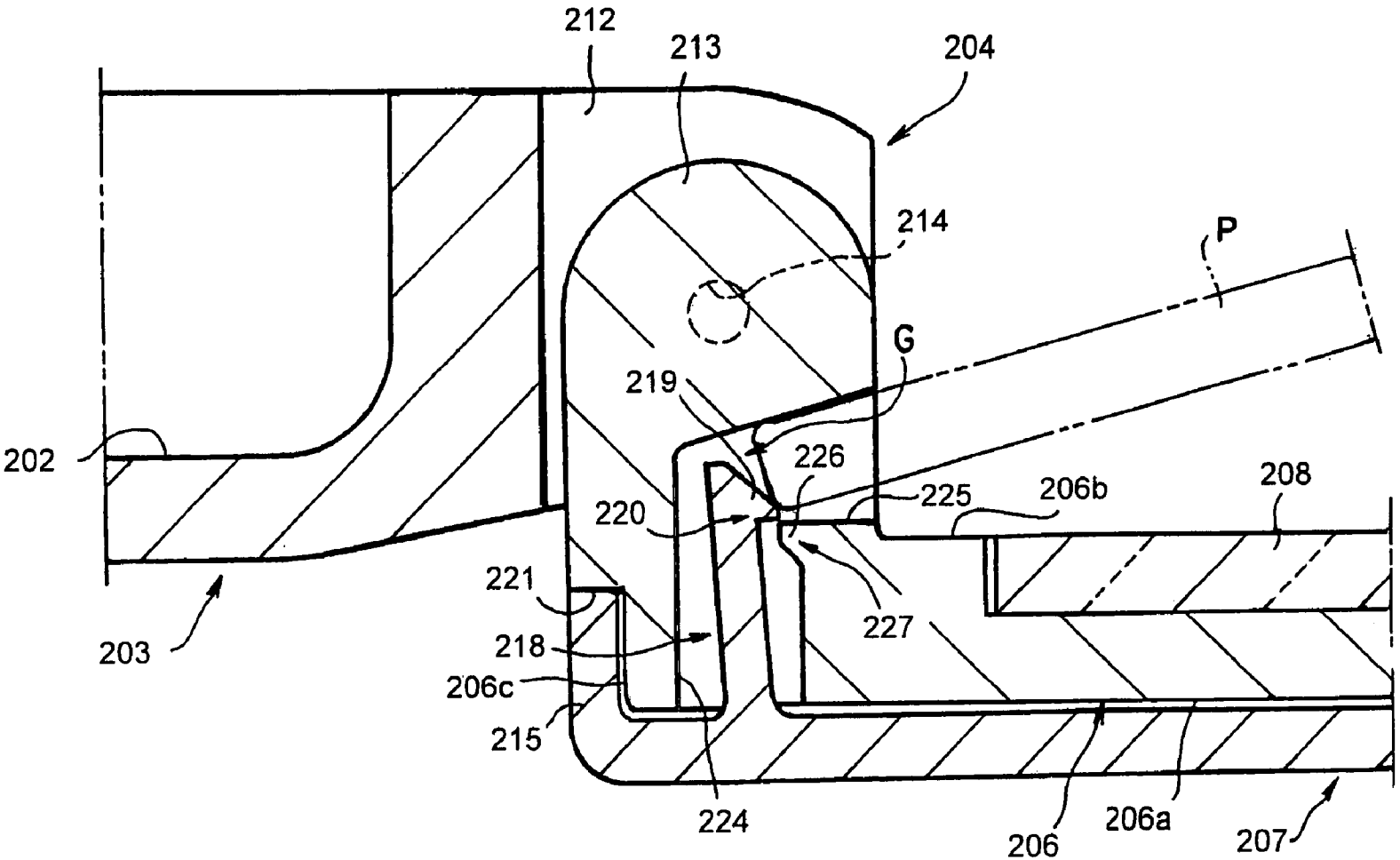
FIG. 8 is a partly enlarged side sectional diagram of the periphery of the hinge block showing a step in progress of removing the replacement cover of the cosmetic container in FIG. 5.
Figure 9:
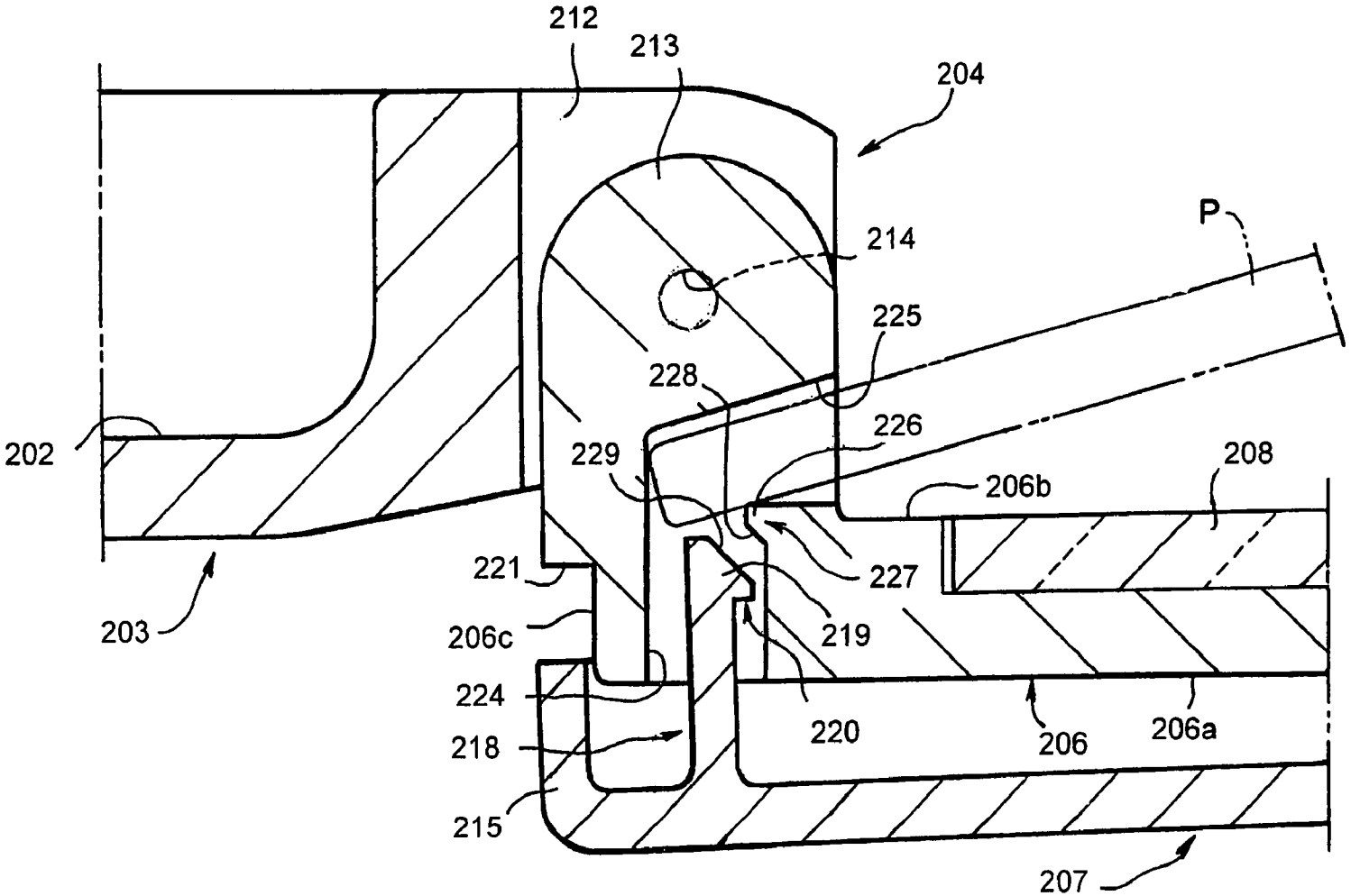
FIG. 9 is a partly enlarged side sectional diagram of the periphery of a hinge block showing a final step in removing the replacement cover of the cosmetic container in FIG. 5.

When the pressing operating tool P pressingly operates the engaging protrusion 219 as shown in FIG. 8, the resilient piece 218 is flexibly deformed in the horizontal direction in the first groove 224, and with the flexible deformation the engaging protrusion 219 separates from the convex rib 226, and the engagement state of the replacement cover 207 to the lid 206 is released. At the same time, the pressing operating tool P inserted into the wedge shaped gap G acts to press down downwardly the resilient piece 218 along the first groove 224, so that with the release of engagement of the engaging protrusion 219 and the convex rib 226, and with pressing down of the resilient piece 218, the replacement cover 207 is separated from the lid 206 to jump out of it as shown in FIG. 9.

Then, by pushing out the replacement cover 207 forward in the horizontal direction of the lid 206, the engaging protrusion 216 can be separated from the engaging recess 222, so that the replacement cover 207 can be removed from the lid 206.

Subsequently, when attaching a new replacement cover 207 to the lid 206, the engaging protrusion portion 216 at the front end side of the lid 206 is inserted in the engaging recess 222 and engaged, and when the resilient piece 218 is inserted into the first groove 224 and the replacement cover 207 is pressed towards the lid 206 at the back end side of the lid 206, the engaging protrusion 219 goes over the convex rib 226 with the flexibly deformation of the resilient piece 218, and at the same time the inner corner portion 220 engages the outer corner portion 227, thus the new replacement cover 207 can be overlapped and attached to the lid 206.

As described above, the cosmetic container 201 according to the present embodiment comprises the replacement cover 207 provided replaceably on the outer surface 206*a* of the lid 206 to cover it, the first groove 224 formed by recessing from the outer surface 206*a* side of the lid 206, the convex rib 226 formed inside the first groove 224, the resilient piece 218 which is flexibly deformable and formed on the replacement cover 207 and which is inserted in the first groove 224 to engageably/detachably engage the convex rib 226, and the second groove 225 formed recessed from the inner surface 206*b* side of the lid 206 and connected to the first groove 224, and to exert operating force to the resilient piece 218 to flexibly deform the resilient piece 218 engaged to the convex rib 226 inside the first groove 224 so as to separate from the convex rib 226. Therefore, the appearance of the cosmetic container 201 is not limited to a design selected by the manufacturer, and the consumers can select the appearance of the cosmetic container 201 according to taste with high flexibility, so that the customers' purchasing inclinations can be increased.

Further, the replacement cover 207 may be formed integrally with the decorated portion inseparably and undetachably as similar to a conventional lid, thus the decorated part does not peel or drop off in part from the replacement cover 207, and the cosmetic container 201 as a product can be provided with a quality appearance and high quality and compare favorably with conventional ones. Further, the second groove 225 to exert operating force to the resilient piece 218 is formed recessed from the inner surface 206*b* side of the lid 206, so that the appearance of the cosmetic container 201 is satisfactory without any convex or concave parts.

Further, in between the engaging protrusion 219 of the resilient piece 218 and the second groove 225, there is formed a wedge shaped gap G to convert a part of the operating force to pressing force to press the replacement cover 207 in a direction to separate from the lid 206, so that when removing the replacement cover 207, the replacement cover 207 can be made to jump out of the lid 206 by pressing the resilient piece 218 using the wedge shaped gap G, so that the user will know that the replacement cover 207 has disengaged from the lid 206, and can more easily remove the replacement cover 207 from the lid 206 because the replacement cover 207 is in a raised state from the lid 206 than when they overlay each other.

Further, by engageably/detachably engaging the engaging protrusion portion 216 and the engaging recess 222, and the engaging protrusion 219 and the convex rib 226, in particular the flexibly deformable engaging protrusion 219 of the resilient piece 218 and the engaged convex rib 226 at the inner corner portions 217, 20 which have an angle and the outer corner portions 223, 27 so it cannot be separated in the vertical direction, the replacement cover 207 can be firmly attached and fixed to the lid 206, so that even if there is a great impact on the cosmetic container 201 due to it falling, the replacement cover 207 will be certainly prevented from easily dropping off from the lid 206.

In this way, the replacement cover 207 can be stably held on the lid 206, and the engaging protrusion 219 and the convex rib 226 can be easily engaged or detached by the pressing operation of the replacement cover 207 to the lid 206 and by the operation from the second groove 225 to flexibly deform the resilient piece 218, and the replacement cover 207 can be easily replaced.

Further, the tapered surface 29 of the engaging protrusion 219 also has an effect to make the engagement with the convex rib 226 smooth, and can make the attaching operation of the replacement cover 207 smooth. Further, by using the hinge block 213 and forming the first groove 224 and the second groove 225 in it, the outer dimension of the cosmetic container 201 can be prevented from becoming large because of the replacement operation of the replacement cover 207.

In the above described second embodiment, a case where the replacement cover 207 is detachably/attachably provided replaceably to cover the lid 206 is given as an example and explained, but the replacement cover 207 can be provided on the container body 203. In this case, the replacement cover 207 can be constructed as similarly to the above embodiment mode, and the first groove 224 can be formed from the outer surface of the container body 203, and the second groove 225 can be formed from the storage recess 202 side.

In the second embodiment, the cosmetic container 201 comprising the hinge 204 and the hook 205 is exemplified and described, but it is not limited thereto, and the invention can be applied to various containers of a type in which the lid 206 is detached and attached by a screw structure or a radial engaging structure to the container body 203.

INDUSTRIAL APPLICABILITY

As described in detail according to the embodiment modes of the present invention, with the cosmetic container of the present invention, by providing a replacement cover detachably/attachably and replaceably, in respect to the cosmetic container having a cosmetic container and a lid which closes and opens it, to at least either one of the lid or the container body, the demand that the decorated part does not peel or fall off in part from the container body or the lid can be met, and the flexibility of the consumers to select the appearance according to taste can be enhanced.

What is claimed is:

1. A cosmetic container comprising:

a container body;

a lid having a hinge portion coupled rotatably to the container body, wherein the lid is configured to open and to close the container body;

a replacement cover provided replaceably on the lid to cover the lid;

a through hole formed in the hinge portion and extending from a lower end of the hinge portion towards the replacement cover;

an engaging body formed on an inner surface of the hinge portion along the through hole;

an engageable body formed on the replacement cover and configured to be inserted into an upper portion of the through hole to detachably engage the engaging body, wherein the engageable body comprises a tapered surface; and a guide portion formed along a lower portion of the through hole, wherein the guide portion is configured to guide an operating item inserted from the lower end of the hinge portion to the tapered surface of the engageable body, and the tapered surface of the engageable body is provided with an inclination configured to disengage the engageable body from the engaging body when the operating item imposes a force upon the inclination.

* * * * *

UNITED STATES PATENT AND TRADEMARK OFFICE

CERTIFICATE OF CORRECTION

PATENT NO. : 7,410,073 B2
APPLICATION NO. : 10/758594
DATED : August 12, 2008
INVENTOR(S) : Yukitomo Yuhara It is certified that error appears in the above-identified patent and that said Letters Patent is hereby corrected as shown below:

On the front page, under the heading (73) Assignee:

Change "Yoshida Co., Ltd." to --Yoshida Industry Co., Ltd.--

Signed and Sealed this

Seventh Day of July, 2009

John Doll

JOHN DOLL
*Acting Director of the United States Patent and Trademark Office*